US009748655B2

(12) United States Patent
Lee et al.

(10) Patent No.: US 9,748,655 B2
(45) Date of Patent: Aug. 29, 2017

(54) POLARIZATION ANTENNA

(71) Applicant: Industry-Academic Cooperation Foundation, Yonsei University, Seoul (KR)

(72) Inventors: Yongshik Lee, Seoul (KR); Taeck Keun Oh, Seoul (KR)

(73) Assignee: Industry-Academic Cooperation Foundation, Yonsei University, Seoul (KR)

( * ) Notice: Subject to any disclaimer, the term of this patent is extended or adjusted under 35 U.S.C. 154(b) by 241 days.

(21) Appl. No.: 14/555,399

(22) Filed: Nov. 26, 2014

(65) Prior Publication Data

US 2015/0207235 A1 Jul. 23, 2015

(30) Foreign Application Priority Data

Jan. 22, 2014 (KR) ..... 10-2014-0007526

(51) Int. Cl.
*H01Q 21/24* (2006.01)
*H01Q 9/04* (2006.01)
*H01Q 13/20* (2006.01)

(52) U.S. Cl.
CPC ..... *H01Q 9/0435* (2013.01); *H01Q 9/0478* (2013.01); *H01Q 13/206* (2013.01); *H01Q 21/24* (2013.01)

(58) Field of Classification Search
CPC ..... H01Q 1/38; H01Q 9/0435; H01Q 9/0478; H01Q 13/206; H01Q 21/24
USPC ..... 343/700 MS, 767, 770, 792.5, 829, 846
See application file for complete search history.

(56) References Cited

U.S. PATENT DOCUMENTS 3,971,032 A * 7/1976 Munson ..... H01Q 9/0421 343/770
4,443,802 A * 4/1984 Mayes ..... H01Q 13/18 343/729
4,531,130 A * 7/1985 Powers ..... H01Q 13/106 343/700 MS
4,590,478 A * 5/1986 Powers ..... H01Q 13/106 343/700 MS
4,672,386 A * 6/1987 Wood ..... H01Q 21/24 343/770

(Continued)

FOREIGN PATENT DOCUMENTS

KR 1020030091383 A 12/2003
KR 1020050069746 A 7/2005

(Continued)

OTHER PUBLICATIONS

2013 International Conference on Electronics, Information and Communication, Jan. 30-Feb. 2, 2013, http://www.iceic2013.org.

(Continued)

*Primary Examiner* — Tho G. Phan
(74) *Attorney, Agent, or Firm* — Procopio, Cory, Hargreaves & Savitch LLP

(57) ABSTRACT

Provided is a polarization antenna. The polarization antenna includes a dielectric substrate; a radiating element formed on the dielectric substrate to be symmetric in up and down and left and right directions; and a balanced feed element including multiple pairs of feed ports which are formed on the dielectric substrate and have a symmetrical structure, applying balanced signals having different phases from each other to the paired feed ports.

13 Claims, 8 Drawing Sheets

(56) References Cited

U.S. PATENT DOCUMENTS

| | | | | | |
|---|---|---|---|---|---|
| 4,916,457 | A * | 4/1990 | Foy | H01Q 21/064 | 343/768 |
| 5,581,266 | A * | 12/1996 | Peng | H01Q 13/106 | 343/767 |
| 6,317,084 | B1 * | 11/2001 | Chen | H01Q 1/38 | 343/700 MS |
| 6,452,552 | B1 * | 9/2002 | Ishitobi | H01Q 9/0407 | 343/700 MS |
| 6,501,427 | B1 * | 12/2002 | Lilly | H01Q 1/38 | 333/33 |

FOREIGN PATENT DOCUMENTS

| | | | |
|---|---|---|---|
| KR | 1020110052899 | A | 5/2011 |
| KR | 1020130046350 | A | 5/2013 |
| KR | 1020130060981 | A | 6/2013 |
| KR | 1020130060982 | A | 6/2013 |

OTHER PUBLICATIONS

The 23rd Joint Conference on communication and Information, May 1, 2013-May 3, 2013, http://jcci.kr.

* cited by examiner

POLARIZATION ANTENNA

CROSS-REFERENCE TO RELATED APPLICATIONS

This U.S. non-provisional patent application claims priority under 35 U.S.C. §119 of Korean Patent Application No. 10-2014-0007526, filed on Jan. 22, 2014, the entire contents of which are hereby incorporated by reference.

BACKGROUND OF THE INVENTION

The present invention disclosed herein relates to a polarization antenna.

Recently, communication traffics are increasing due to an increase in the use of smartphones. Since it is limited to handle such an increase in communication traffic in the existing macro cell environments, it is necessary to introduce a small cell. While the small cell is small in size and thus can handle more users and more data, it has a narrow distance between cells so that an interference phenomenon between neighboring cells may be caused. In order to reduce the interference between neighboring cells, there has been proposed a method of using a dual polarization antenna. Since the use of the dual polarization antenna may raise the spatial gain and increase the channel capacity, it can decrease the interference between cells.

The existing technologies using the dual-polarization antenna include a method of using different feeds in a single radiating element, and a method of selectively using a polarized wave through switching. The method of using different feeds in a single radiating element has a drawback in that it may not obtain the same characteristic over two polarized waves because the antenna does not have a symmetrical structure. The method of selectively using a polarized wave through switching has a drawback in that it may not simultaneously use two polarized waves but may use only one polarized wave at one time.

SUMMARY OF THE INVENTION

The present invention provides a polarization antenna having a high polarization isolation.

The present invention also provides a dual polarization antenna generating dual polarized waves having similar radiation patterns as well as a high polarization isolation (low cross polarization) characteristic.

The objects of the present invention are not limited to the foregoing those, and other objects not described herein will be clearly understood to those skilled in the art from the following description.

Embodiments of the present invention provide polarization antennas including a dielectric substrate; a radiating element formed on the dielectric substrate to be symmetric in up and down and left and right directions; and a balanced feed element including multiple pairs of feed ports which are formed on the dielectric substrate to be symmetric, and applying balanced signals having difference phases from each other to the paired feed ports.

In some embodiments, the balanced signals may be two signals having same amplitude and a phase difference of 180°.

In other embodiments, the radiating element may include a radiating slot radiating a signal; and a plurality of feed patches feeding the radiating slot according to the balanced signals supplied from the feed ports.

In still other embodiments, the plurality of feed patches may include four feed patches disposed on an upper side, a lower side, a left side and a right side with respect to a center of the radiating slot.

In even other embodiments, each of the feed patches may has a triangular shape in which a vertex is oriented toward a center of the radiating slot, and two edges meeting at the vertex are concavely curved lines.

In yet other embodiments, each of the feed patches may have a plurality of slots extending to an interior from each of the two edges.

In further embodiments, the radiating element may further include four stubs formed between the neighboring feed patches in a diagonal direction from the center of the radiating slot to be grounded.

In still further embodiments, the balanced feed element may include first two feed ports corresponding to upper side and lower side feed patches and second two feed ports corresponding to left side and right side feed patches, and apply the balanced signals to the first two feed ports or the second two feed ports.

In even further embodiments, the balanced feed element may further include a ground plane formed on a lower surface of the dielectric substrate, and four slots formed in a diagonal direction from a center of the ground plane.

In yet further embodiments, the balanced feed element may further include a ground part formed at circumference of an upper surface of the dielectric substrate; and via holes penetrating the dielectric substrate along a circumference of the dielectric substrate in order to connect the ground plane and the ground part.

In other embodiments of the present invention, an antenna may include a substrate, a radiating element formed on a first surface of the substrate to be symmetric; and a plurality of feed ports formed on a second surface of the substrate to be symmetric, and a feed element applying signals having the same amplitude and a different phase to the plurality of feed ports.

In still embodiments, the radiating element may include a radiating slot for radiating signal; a plurality of feed patches feeding the radiating slot according to signals supplied from the feed ports; and a stub formed between neighboring feed patches in a diagonal direction from a center of the radiating slot to be grounded.

In even other embodiments, the feed element may further include a ground plane and a slot formed in a diagonal direction from a center of the ground plane.

In still other embodiments of the present invention, dual polarization antennas may include a dielectric substrate; a radiating element formed on a first surface of the dielectric substrate to be symmetric in up and down and left and right directions; and multiple pairs of feed ports formed on a second surface of the dielectric substrate to be symmetric, and a balanced feed element applying balanced signals having the same amplitude and a phase difference of 180° to the paired feed ports, wherein the radiating element includes, a radiating slot radiating a signal; four feed patches disposed on an upper side, a lower side, a left side and a right side with respect to a center of the radiating slot, having a triangular shape in which a vertex is oriented toward a center of the radiating slot, and two edges meeting at the vertex are concavely curved lines, having a plurality of slots extending to an interior from each of the two edges, and feeding the radiating slot according to the balanced signals supplied from the feed ports; and four stubs formed between the neighboring feed patches in a diagonal direction from the center of the radiating slot and grounded.

In even other embodiments, the balanced feed element may include a ground plane; first two feed ports formed on an upper side and a lower side with respect to a center of the ground plane; second two feed ports formed on a left side and a right side with respect to the center of the ground plane; and four slots formed in a diagonal direction from the center of the ground plane in order to separate the feed ports.

In yet other embodiments of the present invention, an antenna may include a substrate; a radiating element formed on a first surface of the substrate to be symmetric in up and down and left and right directions; and a feed element including a plurality of feed ports formed on a second surface of the substrate and having a symmetrical structure, wherein the radiating element includes a radiating slot radiating a signal; four feed patches disposed on an upper side, a lower side, a left side, and a right side with respect to a center of the radiating slot, and feeding the radiating slot; and a stub formed between neighboring feed patches.

In further embodiments of the present invention, the balanced signals including two signals having same amplitude and a phase difference of 180° are applied to the plurality of feed ports.

In still further embodiments of the present invention, the plurality of feed patches may include four feed slots disposed on an upper side, a lower side, a left side and right side with respect to the center of the radiating slot, and feeding the radiating slot according to the balanced signals supplied from the plurality of feed ports, wherein the stub is formed between neighboring feed patches in a diagonal direction from the center of the radiating slot.

In even further embodiments of the present invention, the feed element may include a ground plane; first two feed ports formed on an upper side and a lower side with respect to the center of the ground plane; second two feed ports formed on a left side and a right side with respect to the center of the ground plane; and four slots formed in a diagonal direction from the ground plane in order to separate the feed ports.

BRIEF DESCRIPTION OF THE DRAWINGS

The accompanying drawings are included to provide a further understanding of the present invention, and are incorporated in and constitute a part of this specification. The drawings illustrate exemplary embodiments of the present invention and, together with the description, serve to explain principles of the present invention. In the drawings.

DETAILED DESCRIPTION OF PREFERRED EMBODIMENTS

Figure 1:
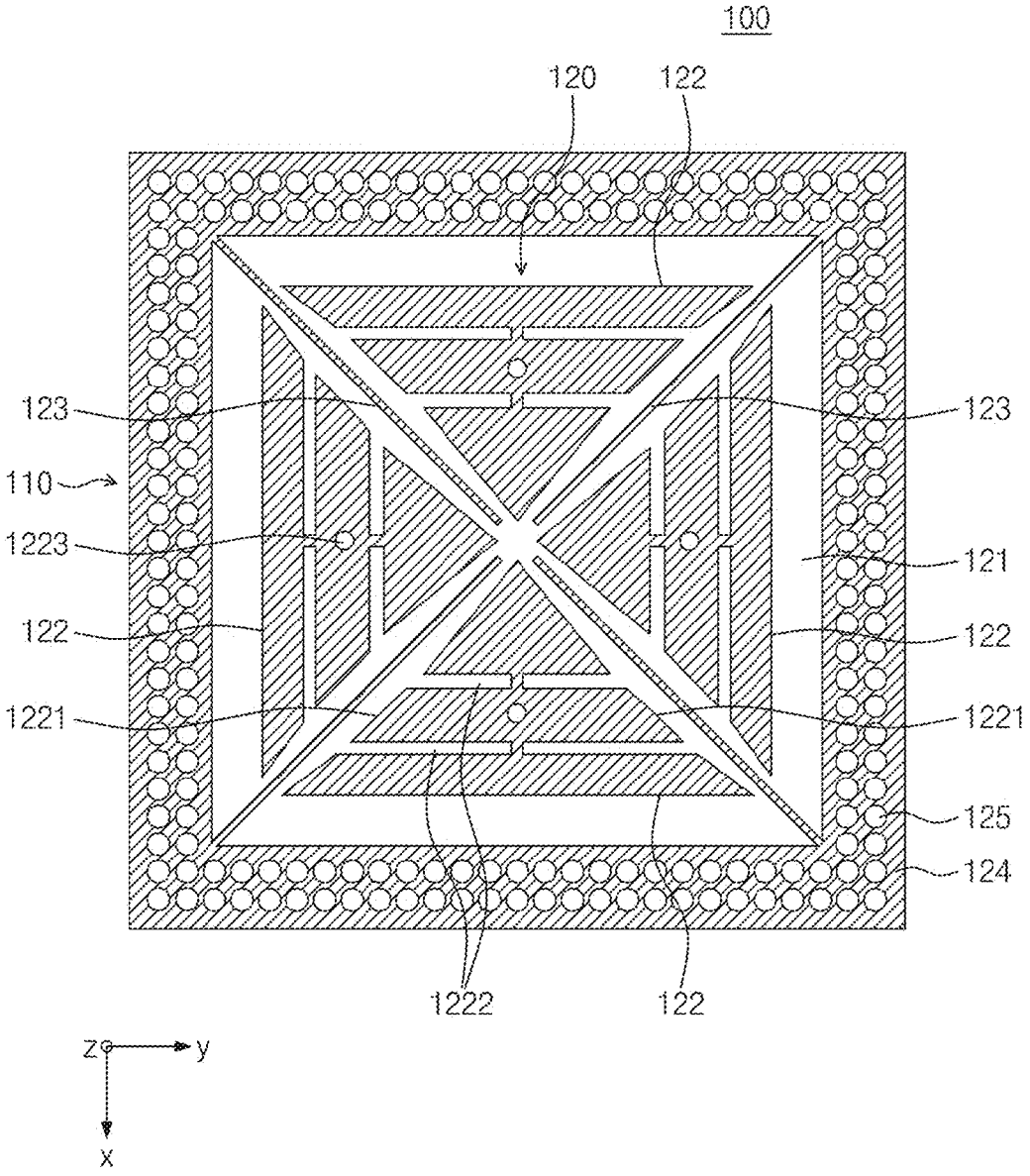
FIG. 1 is a plan view illustrating a polarization antenna according to an embodiment of the present invention.

Other advantages and features of the present invention, and implementation methods thereof will be clarified through following embodiments described with reference to the accompanying drawings. However, the present invention should not be constructed as limited to the embodiments set forth herein, the present invention is only defined by scopes of claims. Although terms are not defined, all terms (including technical terms or science terms) used herein have the same meaning with terms which are generally received by the universal technologies in the conventional art. The general description of disclosed elements will be omitted in order not to obscure the main point of the present. Like reference numerals refer to like elements throughout.

A polarization antenna according to an embodiment of the present invention includes a dielectric substrate, a radiating element formed on the dielectric substrate to be symmetric in up and down and left and right directions, and a balanced feed element including multiple pairs of feed ports which are formed on the dielectric substrate and have a symmetrical structure. The balanced feed element applies balanced signals having different phases from each other, for example, two signals having the same amplitude and a phase difference of 180°, to the paired feed ports. The polarization antenna according to an embodiment of the present invention may generate dual polarized waves having similar radiation patterns as well as high polarization isolation characteristics.

Figure 2:
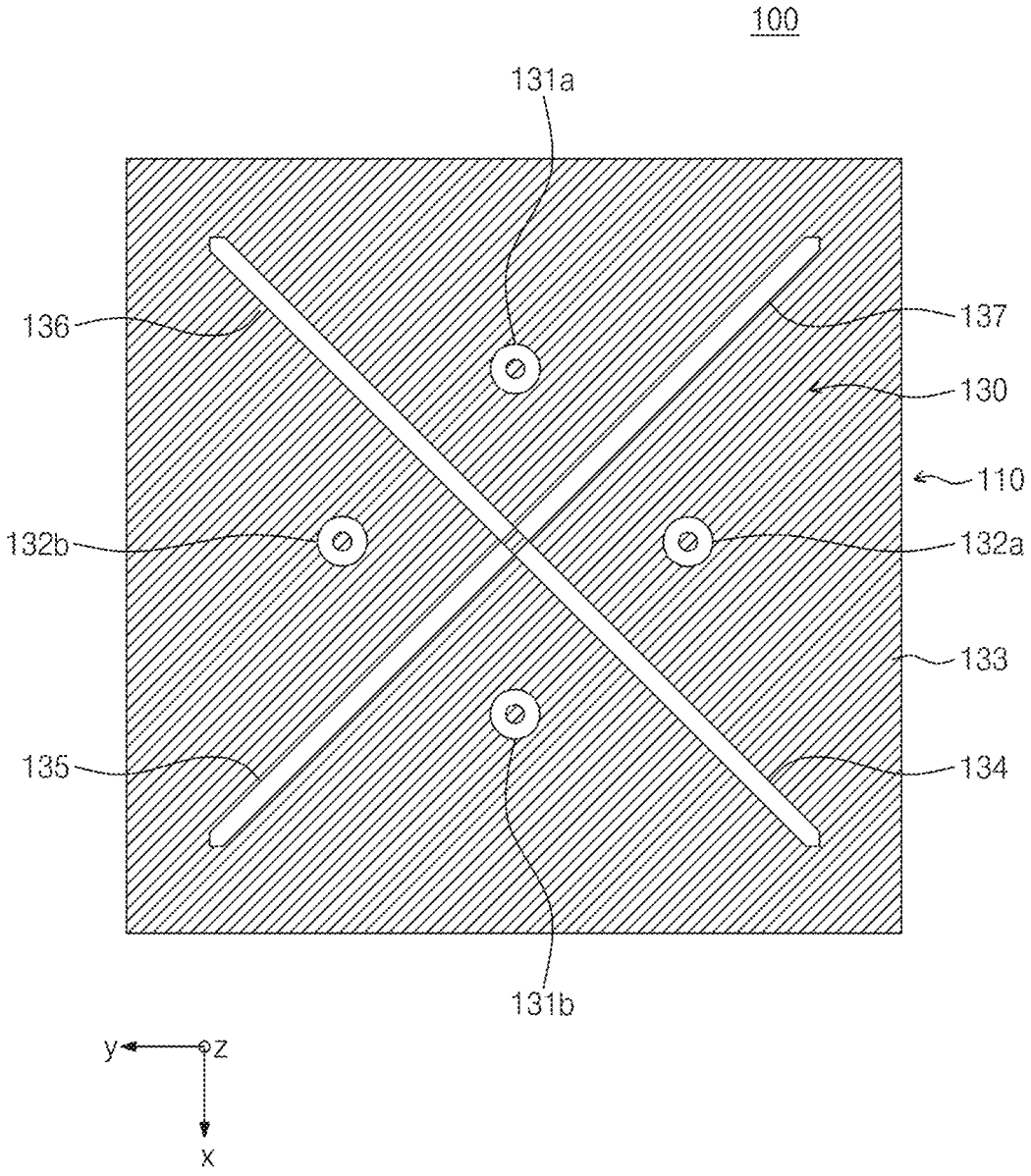
FIG. 2 is a bottom view illustrating a polarization antenna according to an embodiment of the present invention.
Figure 3:
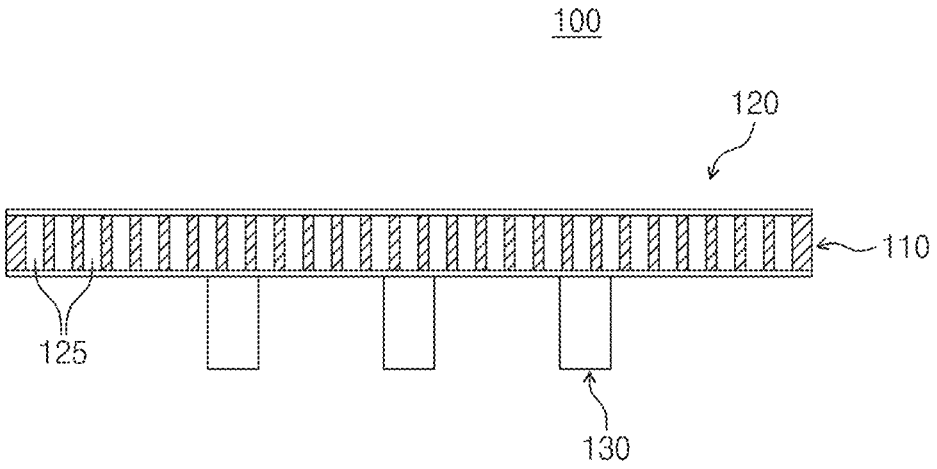
FIG. 3 is a longitudinal sectional view illustrating a polarization antenna according to an embodiment of the present invention.

FIG. 1 is a plan view illustrating a polarization antenna according to an embodiment of the present invention, FIG. 2 is a bottom view illustrating a polarization antenna according to an embodiment of the present invention, and FIG. 3 is a longitudinal sectional view illustrating a polarization antenna according to an embodiment of the present invention. Referring to FIGS. 1 to 3, a polarization antenna 100 according to an embodiment of the present invention includes a dielectric substrate 110, a radiating element 120, and a balanced feed element 130. The dielectric substrate 110 includes a dielectric material. In an embodiment of the present invention, the dielectric substrate 110 is provided in a planar shape. The radiating element 120 may be formed on an upper surface of the dielectric substrate 110. In an embodiment of the present invention, the radiating element 120 is formed on the upper surface of the dielectric substrate 110 to be symmetric in up and down and left and right directions.

The balanced feed element 130 may be formed on a lower surface of the dielectric substrate 110. In an embodiment, the balanced feed element 130 includes multiple pairs of feed ports 131*a*, 131*b*, 132*a*, and 132*b*. The multiple pairs of feed ports 131*a*, 131*b*, 132*a*, and 132*b* are formed on the lower surface of the dielectric substrates 110 to be symmetric in up and down and left and right directions. In an embodiment, balanced signals consisting of two signals having the same amplitude and a phase difference of 180° are applied to one paired first two feed ports 131*a* and 131*b* or one paired second two feed ports 132*a* and 132*b*.

In an embodiment of the present invention, a radiating element 120 includes a radiating slot 121, a plurality of feed patches 122, and a plurality of stubs 123. The radiating slot 121 radiates a signal. That is, the radiating slot 121 operates as a radiating body radiating a signal. The radiating slot 121 is a region that is provided in the shape of a slot by an etching, and may be provided in a square shape. The feed patches 122 feed the radiating slot 121 according to balanced signals supplied from the feed ports 131*a*, 131*b*, 132*a*, and 132*b* through feed points 1223. The feed patch 122 may be formed of a metal layer. In an embodiment, the feed patches 122 consist of four feed patches 122 disposed on an upper side, a lower side, a left side and a right side with respect to a center of the radiating slot 121.

Each of the feed patches 122 has a triangular shape in which a vertex is oriented toward a center of the radiating slot 121. Each of the feed patches 122 is formed by two edges 1221 which meet at the vertex oriented toward the center of the radiating slot 121 and are concavely curved lines. An impedance change according to a frequency change on feeding may be softened by the structure of the concavely cured edges 1221. Each of the feed patches 122 has a plurality of slots 1222, for example, four slots extending to an interior from each of the two concavely cured edges 1221. The slot 1222 of the feed patch 122 may lengthen a current path, thereby reducing the size of the feed patch 122.

The stubs 123 are formed between the neighboring feed patches 122 in a diagonal direction from the center of the radiating slot 121 and grounded. The stubs 123 may be formed of a metal layer. The stubs 123 play a role to block a signal transmission between the feed patches 122. The stubs 123 may block the signal transmission between the feed patches 122 to reduce the cross polarization level and raise the isolation of each polarized wave. In an embodiment, the four power stubs 123 may be formed between the four feed patches 122. The four feed patches 122 are formed on regions where the radiating slot 121 is divided into four parts at an angle of 90°, and the four stubs 123 are formed at an angle of 90°. A ground element 124 is formed on an edge of an upper surface of the dielectric substrate 110. The ground element 124 may be formed of a metal layer. A plurality of via holes 125 are formed to penetrate the dielectric substrate 110 along a circumference of the upper surface of the dielectric substrate 110 such that the ground element 124 on the upper surface of the dielectric substrate 110 is connected to a ground plane 133 on the lower surface of the dielectric substrate 110. As the number of the via holes increases, the potential difference between the ground element 124 on the upper surface of the dielectric substrate 110 and the ground plane 133 on the lower surface of the dielectric substrate 110 is reduced.

The balanced feed element 130 includes a ground plane 133, feed ports 131*a*, 131*b*, 132*a*, and 132*b*, and slots 134, 135, 136, and 137 which are formed on a lower surface of the dielectric substrate 110. The ground plane 133 may be formed of a metal layer. The ground plane 133 may be grounded. In an embodiment, the balanced feed element 130 has four feed ports consisting of first two feed ports 131*a* and 131*b* formed on an upper side and a lower side with respect to a center of the ground plane 133, and second two feed ports 132*a* and 132*b* formed on a left side and a right side with respect to the center of the ground plane 133. The first feed ports 131*a* and 131*b* are formed corresponding to the two feed patches 122 formed on an upper side and a lower side with respect to a center of the dielectric substrate 110, and the second two feed ports 132*a* and 132*b* are formed corresponding to the two feed patches 122 formed a left side and a right side with respect to the center of the dielectric substrate 110.

Feeding may be conducted by the two paired feed ports. For example, a balanced signal may be applied to the first two feed ports 131*a* and 131*b* or the second two feed ports 132*a* and 132*b*. For example, when a balanced signal is applied to the first two feed ports 131*a* and 131*b*, a vertically polarized wave is generated, and when a balanced signal is applied to the second two feed ports 132*a* and 132*b*, a horizontally polarized wave is generated. When balanced signals are applied to the first two feed ports 131*a* and 131*b* and the second two feed ports 132*a* and 132*b*, a vertically polarized wave and a horizontally polarized wave are concurrently generated. In an embodiment, balanced signals may be applied to the feed ports 131*a*, 131*b*, 132*a*, and 132*b* by using a balun device (not shown). For example, the balun device may be provided with a phase shifter (not shown) shifting a phase of a signal by an angle of 180°.

In an embodiment, slots 134, 135, 136, and 137 are formed in a diagonal direction from a center of a ground plane in order to separate the feed ports 131*a*, 131*b*, 132*a*, and 132*b*. The slots 134, 135, 136, and 137 of the balanced feed element 130 block signal transmission between the respective feed ports 131*a*, 131*b*, 132*a*, and 132*b* to reduce the cross polarization level and increase the isolation of each polarization wave. In an embodiment, the four slots 134, 135, 136, and 137 may be formed at an angle of 90°. According to embodiments of the present invention, the cross polarization level may be effectively reduced, high polarization isolation characteristics may be obtained, and dual polarized waves having similar radiation patterns may be generated. In embodiments of the present invention, since a switching structure selecting a polarized wave is not needed, there is also an advantage that can miniaturize a polarization antenna.

Figure 4:
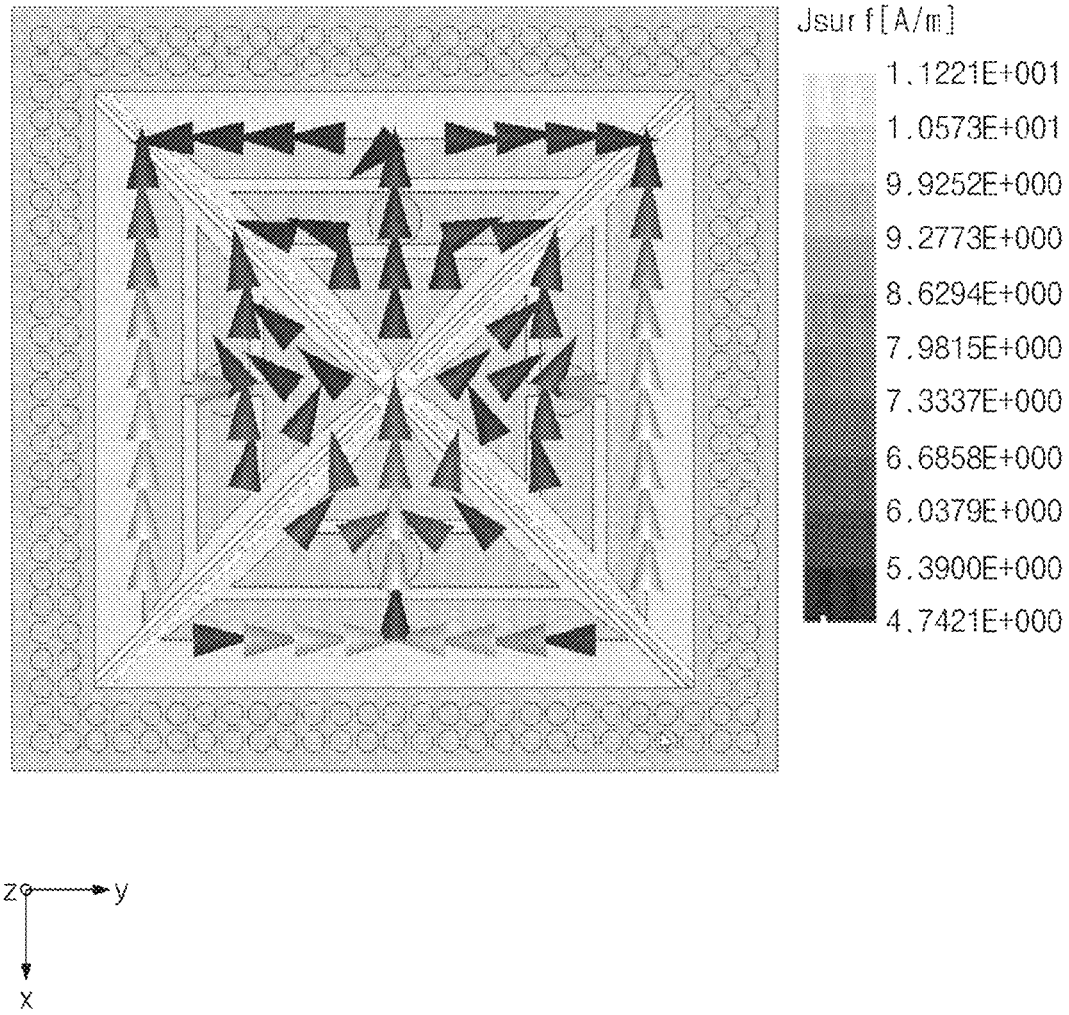
FIGS. 4 and 5 are cross-sectional views showing current flows of a polarization antenna according to an embodiment of the present invention.
Figure 5:
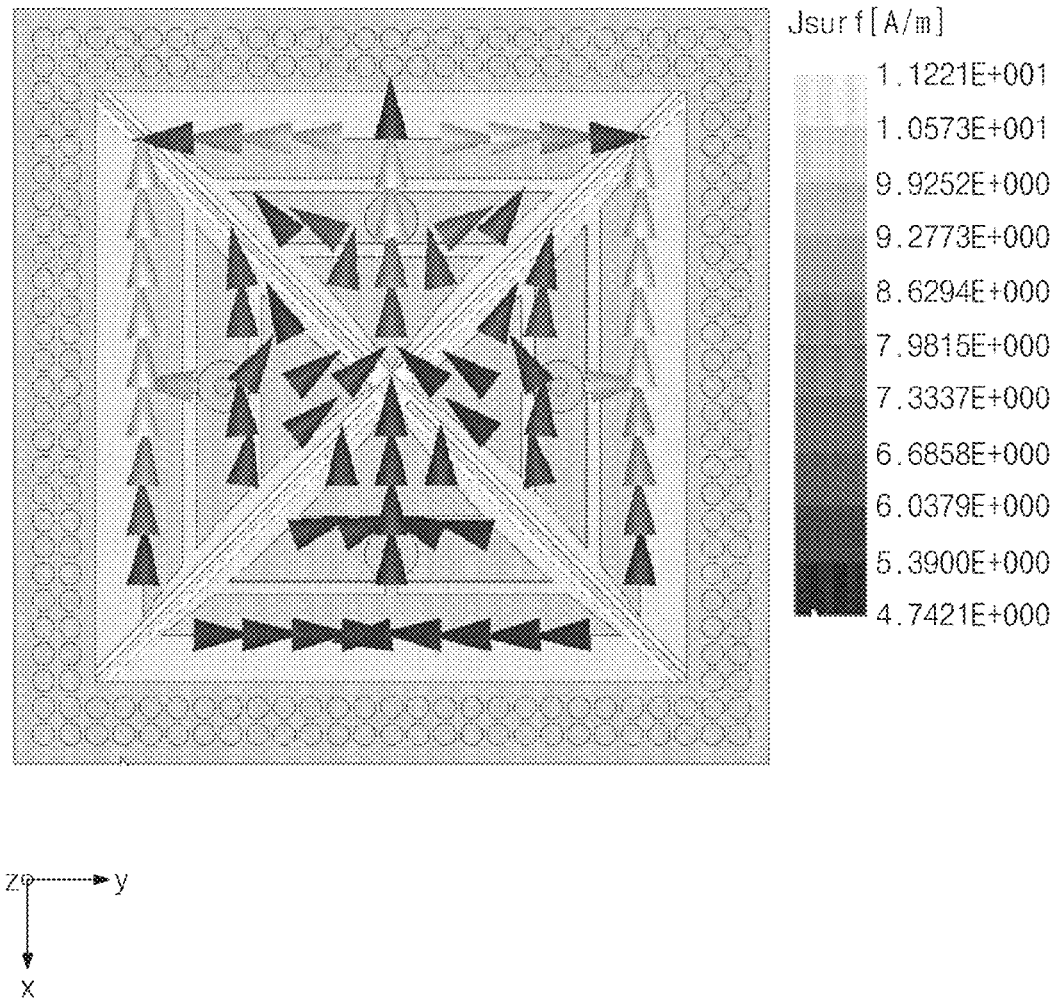

FIGS. 4 and 5 are cross-sectional views showing current flows of a polarization antenna according to an embodiment of the present invention. FIG. 4 shows surface currents of the polarization antenna 100 when a signal is fed to the lower side feed port 131*b*, and FIG. 5 shows surface currents of the polarization antenna 100 when a signal having a phase difference of 180° from said the above signal is fed to the upper side feed port 131*a*. Referring to FIGS. 4 and 5, since currents flowing in a Y-axis direction (a horizontal direction in FIGS. 4 and 5) are generated to be symmetric to each other on the basis of an X-axis direction (a vertical direction in FIGS. 4 and 5), the currents are canceled each other. Also, currents (currents of a cross polarization direction) flowing in the Y-axis direction are canceled each other by the signal fed to the lower side feed port 131*b* due to the balanced feed structure of the polarization antenna 100, and currents (currents of a major co polarization direction) flowing in the X-axis direction are supplemented. That is, since the currents of the cross polarization direction flow in opposite directions to each other, and the currents of the major cross polarization direction flow in the same direction, the cross polarization wave level may be reduced and high polarization wave isolation characteristics may be obtained.

Figure 6:
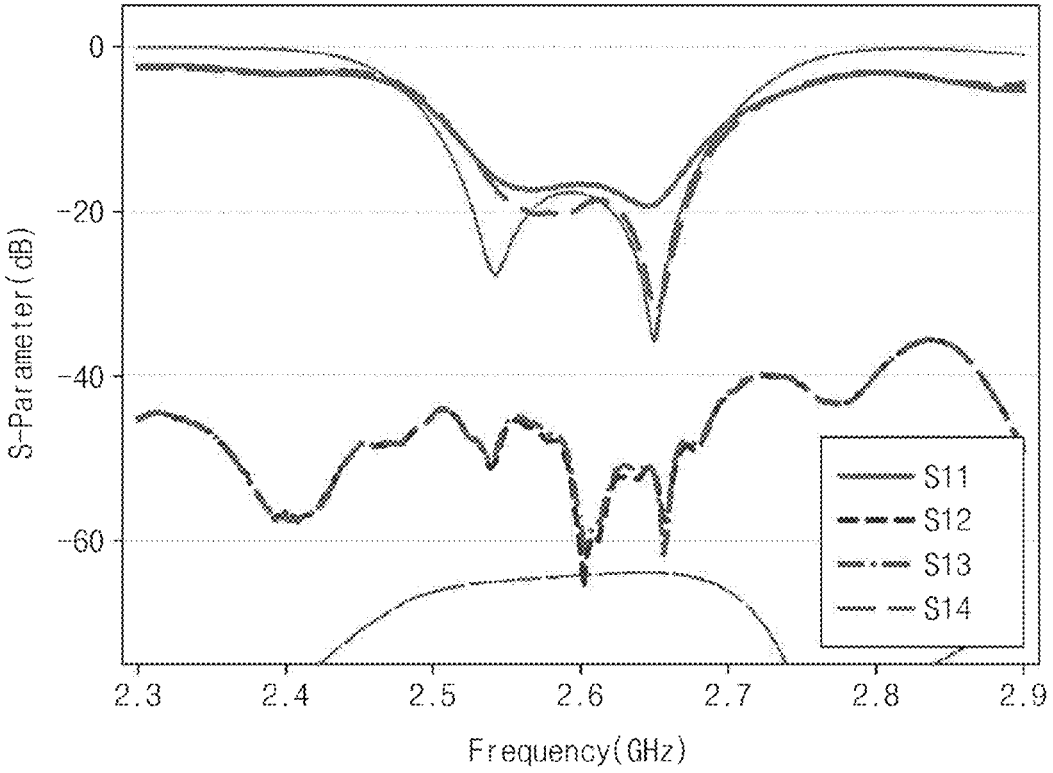
FIG. 6 is a graph showing S-parameter characteristics according to frequencies according to an embodiment of the present invention.

FIG. 6 is a graph showing S-parameter characteristics according to frequencies according to an embodiment of the present invention. In FIG. 6, a relatively thin line represents a result of analyzing S-parameter characteristics of a polarization antenna 100 according to an embodiment of the present invention through a simulation, and a relatively thick line represents a result of measuring S-parameter characteristics of the polarization antenna 100 actually manufactured according to an embodiment of the present invention. Referring FIG. 6, it may be understood that the isolation between first feed ports 131*a* and 131*b* and second feed ports 132*a* and 132*b* is 40 dB or more in a frequency bandwidth of 2.5 GHz to 2.7 GHz due to the balanced feed structure and symmetrical structure of the polarization antenna 100 according to an embodiment of the present invention.

Figure 7:
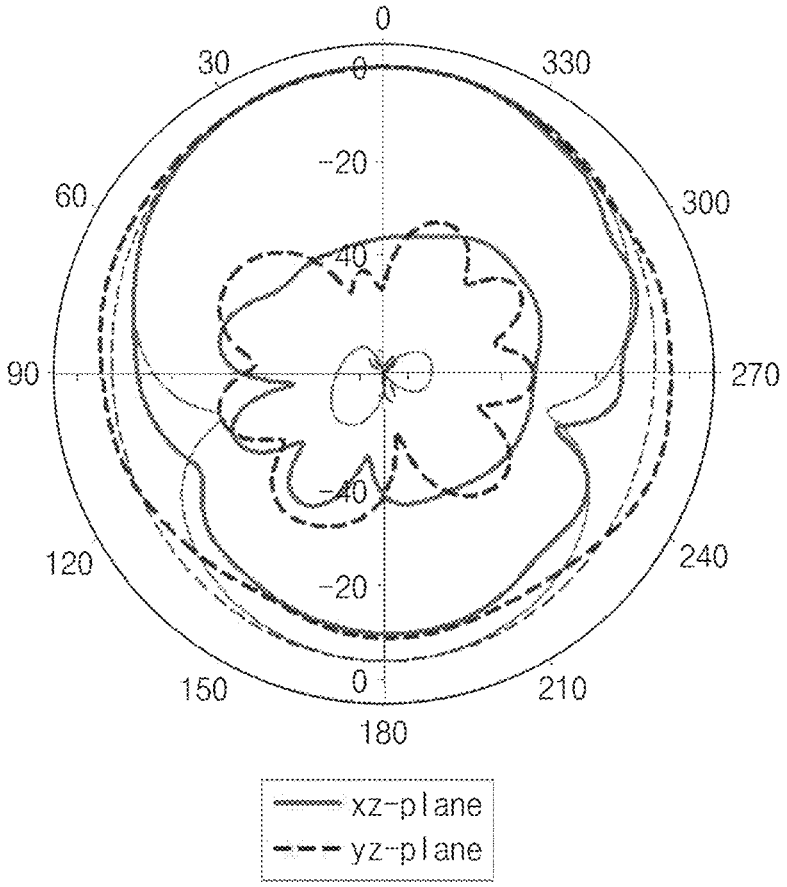
FIGS. 7 and 8 are graphs showing radiation patterns according to an embodiment of the present invention.
Figure 8:
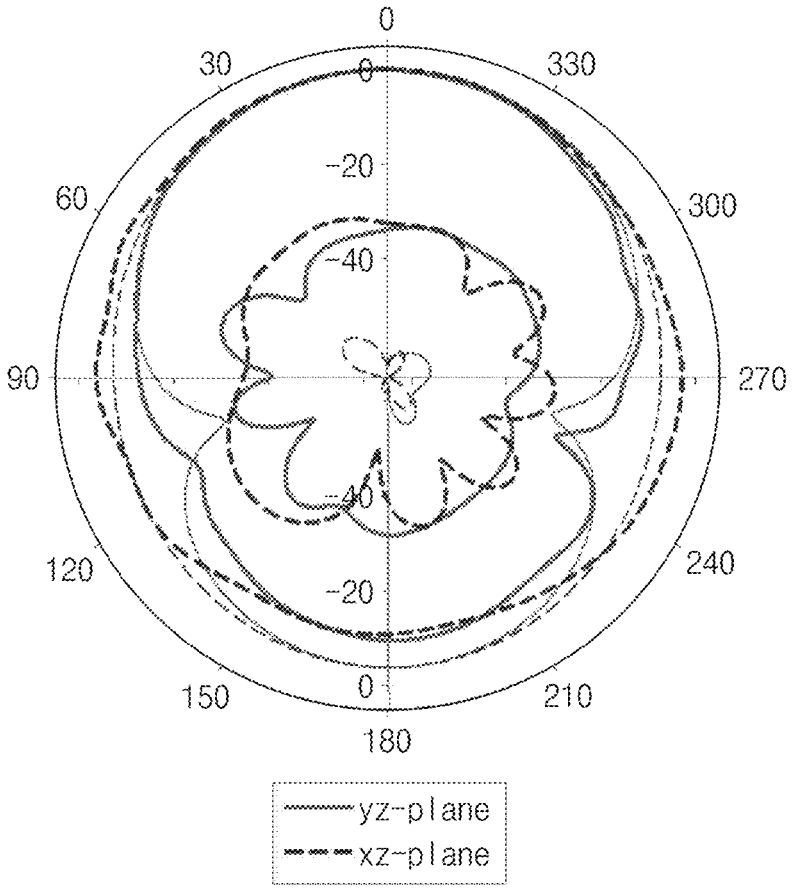

FIGS. 7 and 8 are graphs showing radiation patterns according to an embodiment of the present invention. In FIGS. 7 and 8, a relatively thin line represents a result of analyzing the radiation pattern of a polarization antenna 100 according to an embodiment of the present invention through a simulation, and a relatively thick line represents a result of measuring the radiation pattern of the polarization antenna 100 actually manufactured according to an embodiment of the present invention. The bandwidth for measurement of the radiation pattern was set at 2.6 GHz. Referring FIGS. 7 and 8, it may be understood that the level of cross polarization wave is not more than −30 dB within a half-power beam width due to the balanced feed structure and the symmetrical structure of the polarization antenna 100 according to embodiments of the present invention, and the radiation patterns of two polarized waves are similarly represented.

According to embodiments of the present invention described above, a dual linear polarization antenna which has high polarization isolation (low cross polarization wave) characteristics, and in which two polarized waves have the same characteristic may be provided. In accordance with embodiments of the present invention, two linear polarized waves having the same characteristics and crossing at right angles may be generated. Therefore, the dual polarization antenna according to embodiments of the present invention may reduce the interference between neighboring cells in the wireless communication system, and increase the channel capacity.

Embodiments described above are provided so that this disclosure will be thorough and complete, and should not be constructed as limited to the embodiments. Rather, it should be understood that various modifiable embodiments are belong to scopes of the present invention. Further, the range of protection of the present invention is defined by technical idea of claims, the range of protection of the present invention is not limited to literal description itself, however, it should be understood that technical value of the present invention extends to inventions of equivalent scope.

What is claimed is:

1. A polarization antenna comprising:

a dielectric substrate;

a radiating element formed on the dielectric substrate to be symmetric in up and down and left and right directions; and a balanced feed element including multiple pairs of feed ports which are formed on the dielectric substrate and have a symmetrical structure, wherein the radiating element comprises:

four feed patches having a triangular shape and being spaced apart from each other; and four stubs which are formed between neighboring feed patches and grounded, each of the four stubs being spaced apart from the feed patches.

2. The polarization antenna of claim 1, wherein the four feed patches are disposed on an upper side, a lower side, a left side and a right side with respect to a center of the polarization antenna.

3. The polarization antenna of claim 2, wherein a vertex of each of the feed patches is oriented toward a center of the polarization antenna, and two edges of each of the feed patches meeting at the vertex are concavely curved lines.

4. The polarization antenna of claim 3, wherein each of the feed patches has a plurality of slots extending to an interior from each of the two edges.

5. The polarization antenna of claim 2, wherein the multiple pairs of feed ports comprise first two feed ports corresponding to the upper and lower side feed patches, and second two feed ports corresponding to left and right side feed patches.

6. The polarization antenna of claim 5, further comprising a ground plane formed on a lower surface of the dielectric substrate, and four slots formed in a diagonal direction from a center of the ground plane.

7. The polarization antenna of claim 6, further comprising:

a ground part formed at circumference of an upper surface of the dielectric substrate; and via holes penetrating the dielectric substrate along a circumference of the dielectric substrate, in order to connect the ground plane and the ground part.

8. An antenna comprising:

a substrate;

a radiating element formed on a first surface of the substrate to be symmetric; and a feed element comprising a plurality of feed ports which are formed on a second surface of the substrate and have a symmetrical structure, wherein the radiating element comprises:

four feed patches having a triangular shape and being spaced apart from each other; and four stubs which are formed between neighboring feed patches and grounded, each of the four stubs being spaced apart from the feed patches.

9. The antenna of claim 8, further comprising a ground plane and a slot formed in a diagonal direction from a center of the ground plane.

10. A dual polarization antenna comprising:

a dielectric substrate;

a radiating element formed on a first surface of the dielectric substrate to be symmetric in up and down and left and right directions; and a balanced feed element including multiple pairs of feed ports which are formed on the dielectric substrate and have a symmetrical structure, wherein the radiating element comprises:

four feed patches having a triangular shape and being spaced apart from each other; and four stubs which are formed between neighboring feed patches and grounded, each of the four stubs being spaced apart from the feed patches, a radiating slot wherein a vertex of each of the four feed patches is oriented toward the center of the radiating slot, wherein two edges of each of the feed patches meeting at the vertex are concavely curved lines, and wherein each of the feed patches has a plurality of slots extending to an interior from each of the two edges.

11. The dual polarization antenna of claim 10, wherein the multiple pairs of feed ports comprise, a ground plane;

first two feed ports formed on an upper side and a lower side with respect to a center of the ground plane;

second two feed ports formed on a left side and a right side with respect to the center of the ground plane; and four slots formed in a diagonal direction from the center of the ground plane in order to separate the feed ports from each other.

12. An antenna comprising:

a substrate;

a radiating element formed on a first surface of the substrate to be symmetric in up and down and left and right directions; and a feed element comprising a plurality of feed ports formed on a second surface of the substrate and having a symmetrical structure, wherein the radiating element comprises, an antenna having four feed patches each having a triangular shape, and the four feed patches being spaced apart from each other; and four stubs formed between the neighboring feed patches, each of the four stubs being grounded and apart from the feed patches.

13. The antenna of claim 12, wherein the plurality of feed ports comprise, a ground plane;

first two feed ports formed on an upper side and a lower side with respect to the center of the ground plane;

second two feed ports formed on a left side and a right side with respect to the center of the ground plane; and four slots formed in a diagonal direction from the ground plane in order to separate the feed ports.

* * * * *